US006701992B1

(12) United States Patent
Pasquale et al.

(10) Patent No.: US 6,701,992 B1
(45) Date of Patent: Mar. 9, 2004

(54) AUTOMATIC BUTT SPLICER FOR CONVERTING MACHINE

(75) Inventors: Robert A. Pasquale, Hawthorne, NJ (US); Frank Lembo, Ramsey, NJ (US)

(73) Assignee: New Era Converting Machinery, Inc., Patterson, NJ (US)

( * ) Notice: Subject to any disclaimer, the term of this patent is extended or adjusted under 35 U.S.C. 154(b) by 0 days.

(21) Appl. No.: 10/260,213

(22) Filed: Sep. 27, 2002

(51) Int. Cl.[7] ..... A65H 21/00; B61F 5/06

(52) U.S. Cl. ..... 156/504; 156/502; 156/505; 156/507; 156/304.1; 156/304.3

(58) Field of Search ..... 156/304.1, 304.3, 156/502, 504, 505, 506, 507

(56) References Cited

U.S. PATENT DOCUMENTS 5,277,731 A 1/1994 Krimsky et al. ..... 156/159
5,772,150 A * 6/1998 Spatafora ..... 242/554.1
6,237,217 B1 * 5/2001 Bohn et al. ..... 29/806
6,481,664 B1 * 11/2002 Bravin ..... 242/552

FOREIGN PATENT DOCUMENTS

JP 60-56613 * 12/1985 ..... 156/507

* cited by examiner

*Primary Examiner*—Mark A. Osele
(74) *Attorney, Agent, or Firm*—Darby & Darby

(57) ABSTRACT

A butt splicer lengthens a travel distance of a lap-spliced web by a predetermined distance. A pair of knives, spaced apart by the predetermined distance are fired when the lap splice is between them. The severed ends of the web are brought together on a vacuum roll for the application of a tape bridging the upstream and downstream ends. In one embodiment, a second tape is applied to the second side of the web to form a double butt splice.

6 Claims, 10 Drawing Sheets

AUTOMATIC BUTT SPLICER FOR CONVERTING MACHINE

BACKGROUND

The present invention relates to converting machines and, in particular to techniques for accomplishing butt splicing in converting machines.

Converting machinery is used to feed a web of paper, or other product from a roll to a using process. When the web on one roll expires, the leading edge of a web on a new roll must be attached. One way for attaching the leading edge includes shutting down and stopping the web, manually severing the tail end of the web from the expiring roll, and affixing the leading edge of the new roll. This procedure, of course, requires discontinuous feeding of the web to the using process.

In order to permit continuous feed from the roll to the using process, it is conventional to prepare a new roll by adding double-sided tape to its leading edge. As the expiring roll is nearly depleted, the new roll is rotated up to a peripheral speed equal to the web speed. A bump roll displaces the expiring web into contact with the double-sided tape, which adheres the leading edge of the web from the new roll to the moving web. Substantially simultaneously, a cutting bar is fired to sever the tail of the old web.

The type of splice above described is called a lap splice. That is, the location of the splice contains the expired web, the leading edge of the new web, and the double-sided tape between the two webs. Although many processes can tolerate lap splices, there are some which cannot. For example, when the web is relatively thick, the combined thicknesses of the two overlapped webs plus the double-sided tape may be more than the downstream using process can tolerate.

A butt splice is one in which the trailing edge of the expiring web is abutted, not overlapped, by the leading edge of the new web. One technique for practicing a butt splice on-the-fly is disclosed in U.S. Pat. No. 5,277,731, the disclosure of which is herein incorporated by reference. In that technique, a lap splice is first prepared, substantially as in the prior art described above. Then, the tail end of the expiring web, overlapped with the leading edge of the new web, is severed. The free tail end is diverted, so that the expiring and new webs ends abut each other, with single-sided tape joining the two webs. However, the original lap splice remains attached to the expiring web upstream of the cut. This original lap splice must be removed. This is done by a further cut in the expiring web to isolate the lap splice, together with leading and trailing portions of the expiring web, still attached to the butt-spliced web. Then, the lap splice must be removed. The disclosure of the '731 patent suggests forming the lap splice using a double-sided tape of limited adhesive strength, so that its adherence is weak enough to be relatively easily overcome. One way suggested for disposing of the debris is to change the web direction sharply after butt splicing so that the butt splice and new web follow the changed direction, while the debris continues generally straight ahead. Separation is aided by a fixed blade.

In order to thicken the lap splice, and thus improve the ability to separate the debris, the above technique adds a length of stiff material between two layers of double-sided tape. This three-layer structure is then used to form the lap splice. Several disadvantages are foreseen in the prior-art technique. The certainty of separating the debris from the advancing web may be less that perfect. The amount of labor required to lay up two layers of double-sided tape plus the stiffening material exceeds that required for a simple lap splice, thereby increasing labor cost. Finally, the debris is quite bulky, thereby complicating disposal.

The prior-art technique is incapable of butt splicing a double-layer web in which the top layer of the expiring web is butt spliced to the top layer of the new web, and the bottom layer of the expiring web is butt spliced to the bottom layer of the new web.

OBJECTS AND SUMMARY OF THE INVENTION

Accordingly, it is an object of the invention to provide a butt splicer for converting machinery that overcomes the drawbacks of the prior art.

It is a further object of the invention to provide a butt splicer for converting machinery that lengthens the web path of a lap-spliced web, then severs the web before and after the lap splice so that, the lengthened path places the trailing end of the expiring web abutting the leading end of the new web. A single-sided tape is applied over the abutting ends to form the butt splice.

It is a still further object of the invention to form a butt splice in a two-layered web as described in the foregoing paragraph, and also to apply a single-sided tape over the abutting ends on the other side of the web. Thus, when the two-layer web leaves the butt splicer, the top layer of the expiring web is butt spliced to the top layer of the new web, and the bottom layer of the expiring web is butt spliced to the bottom layer of the new web. This permits downstream separation of the top and bottom layers by the using process.

Briefly stated, the present invention provides a butt splicer lengthens a travel distance of a lap-spliced web by a predetermined distance. A pair of knives, spaced apart by the predetermined distance are fired when the lap splice is between them. The severed ends of the web are brought together on a vacuum roll for the application of a tape bridging the upstream and downstream ends. In one embodiment, a second tape is applied to the second side of the web to form a double butt splice.

According to an embodiment of the invention, there is provided a butt splicer for butt splicing a web which contains a previously performed lap splice, comprising: first and second knives, the first and second knives being spaced apart a predetermined distance in a web-motion direction, means for lengthening a travel distance of the web between working positions of the first and second knives from an original travel distance by an amount equal to the predetermined distance, means for energizing the first and second knives when the lap splice passes therebetween to remove a waste portion of the web containing the lap splice, means for restoring the original travel distance of the web, whereby severed ends of the web are placed in abutment with each other, and means for applying a tape bridging the severed ends, whereby a butt splice is produced.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
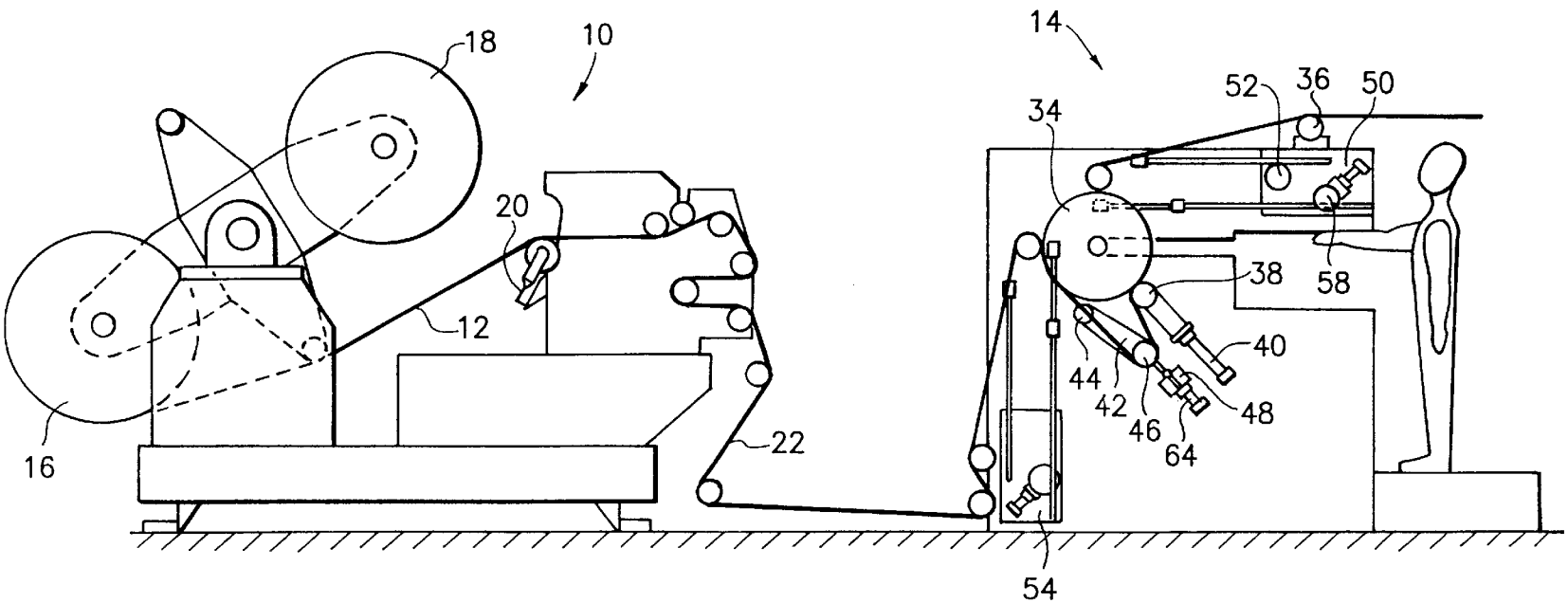
FIG. 1 is a simplified side view of converting machine including a butt splicer, according to an embodiment of the invention, on its downstream end.

Referring to FIG. 1, there is shown, a conventional turret unwind 10 followed in the travel direction of a web 12, by a butt splicer 14, according to the present invention. In the following, the term downstream indicates the direction of web 12 travel, and upstream indicates the opposite direction.

Figure 2:
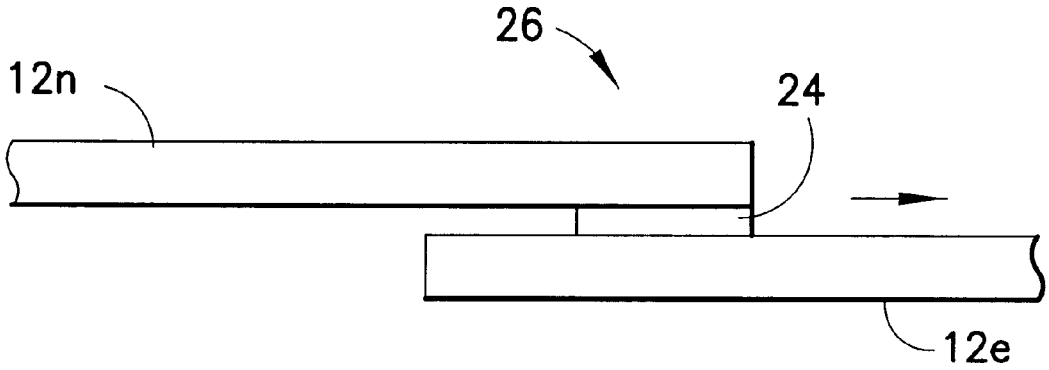
FIG. 2 is a cross section of a lap splice in a web.

Since turret unwind 10 is conventional, a detailed description thereof is considered to be unnecessary, and is thus omitted herefrom. For present purposes, it is sufficient to note that turret unwind 10 feeds web 12 to a using process (not shown) from an active roll 16 (also called expiring roll). As active roll 16 is depleted, a new roll 18 is mounted and rotated into a position adjacent web 12. Referring now also to FIG. 2, new roll 18 is prepared by affixing a double-sided tape 24 across its width at the leading edge of the new web 12*n*. A conventional tear strip (not shown) holds down the leading edge of new web 12*n* until the critical moment. As active roll 16 nears depletion, new roll 18 is spun up until its surface speed matches the advance speed of web 12. Then, a knife 20 is activated to sever web 12, at the same time that a bump roll (not numbered) urges web 12 into contact with the double-sided tape. The strong adhesion of the double-sided tape is sufficient to separate the tear strip so that the new web 12 is joined by a lap splice 26 to the trailing end of the expiring web 12.

After lap splicing, the portion of turret unwind 10 previously holding active roll 16 is rotated into an inactive loading position, while the portion previously holding new roll 18 is rotated into the supplying position. A replacement roll is loaded for repeating the operation. For present purposes, it is sufficient to understand that the exiting web 22 includes a lap splice 26 from time to time, as new rolls are placed in use. Exiting web 22 is fed to butt splicer 14.

From FIG. 2, it is seen that lap splice 26 has a triple thickness consisting of the sum of thicknesses of expiring web 12*e*, double-sided tape 24 and new web 12*n*. Although many using processes can accommodate such triple thickness, many cannot. Such thickness becomes a special problem when web 12 is itself thick. As can be seen in the figure, lap splice 24 affixes the bottom of new web 12 to the top of expiring web 12*e*. If web 12 consists of two layers, lap splice 26 does not permit separating the layers downstream.

It will be noted that butt splicer 14 may be added downstream of an existing turret unwind 10. This adds flexibility to the user of the converting machinery.

The remainder of the present disclosure is directed to butt splicer 14.

Figure 3:
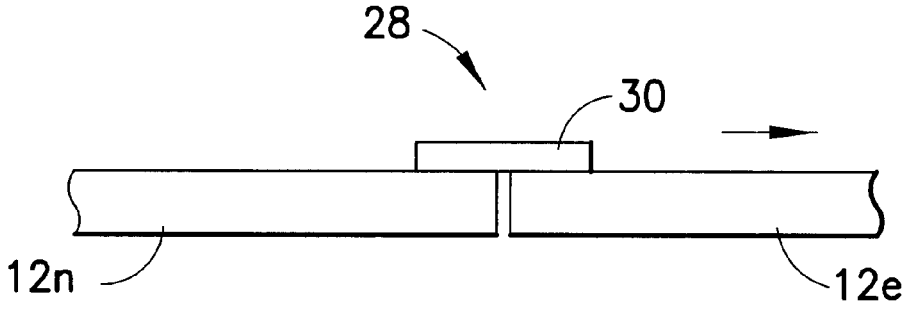
FIG. 3 is a cross section of a butt splice in a web.

Referring now to FIG. 3, in a butt splice 28, the trailing end of expiring web 12*e* is held immediately adjacent the leading end of new web 12*n* by a single-sided tape 30. Thus, the total thickness of butt splice 28 is the sum of a single thickness of web 12 and tape 30. Usually, the thickness of tape 30 is negligible. Thus, the using process is generally capable of continuing processing of web 12 past butt splice 28 without interruption.

FIGS. 4–13 illustrate only active elements of butt splicer 14. Conventional frames, bearings, etc. are omitted from illustration and explanation in the interest of clarity of description.

Figure 4:
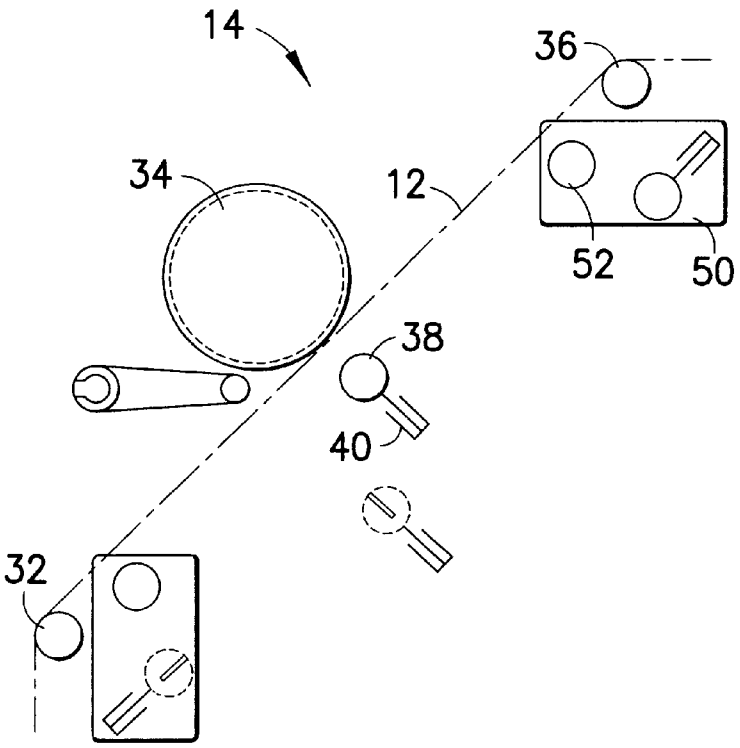
FIG. 4 shows the functional elements of the butt splicer of FIG. 1 in its quiescent condition.

Referring specifically to FIG. 4, the quiescent condition is shown in which web 12 passes over an entry idler 32, in contact with, or in close proximity to, a vacuum roll 34 and exits over an exit idler 36. The vacuum in vacuum roll 34 is turned off in this condition. In preparation for splicing, the surface speed of vacuum roll 34 is brought up to match the line speed of web 12.

Figure 5:
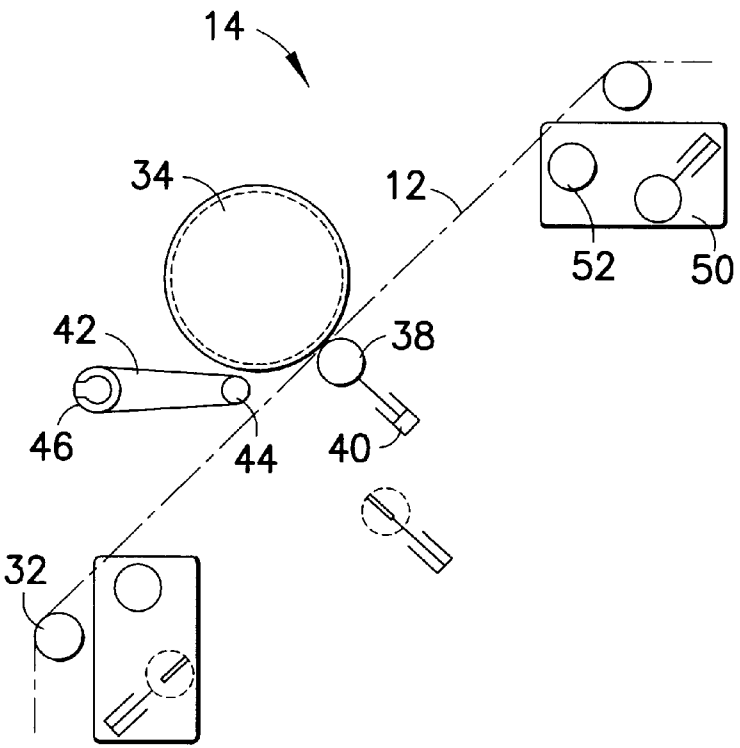
FIGS. 5–13 show the sequence of operation performed by the elements of the butt splicer shown in FIG. 4.

Referring now to FIG. 5, a nip roll 38 is actuated by a pneumatic cylinder 40 into contact with web 12. This urges web 12 into contact with the surface of vacuum roll 34. The drive of vacuum roll 34 has heretofore been speed control to match its surface speed to the line speed. At this point in the operation, drive of vacuum roll 34 is switched to tension control, which is regulated by a conventional dancer roll, or a force transducer mounted roll (neither of which is shown) upstream of entry idler 32. A pair of adjustable position arms 42 (only the near one of which is shown) are rotated about their axes 44 to position a position roll 46, spanning the pair of adjustable position arms 42, clear of web 12.

Figure 6:
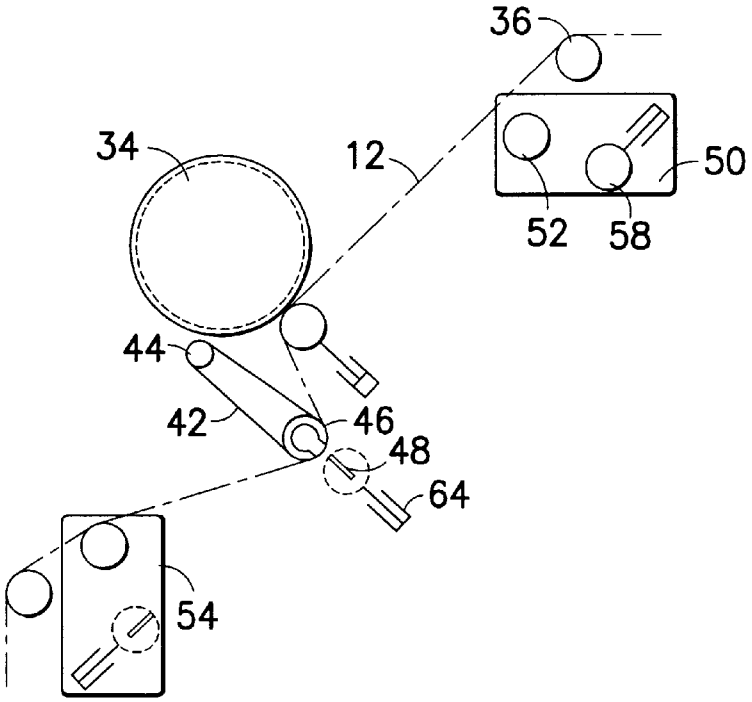

Referring now to FIG. 6, adjustable position arms are rotated counterclockwise about axis 44 to deflect web 12 outward until if faces a secondary cutoff knife 48. Travel of web 12 continues.

Figure 7:
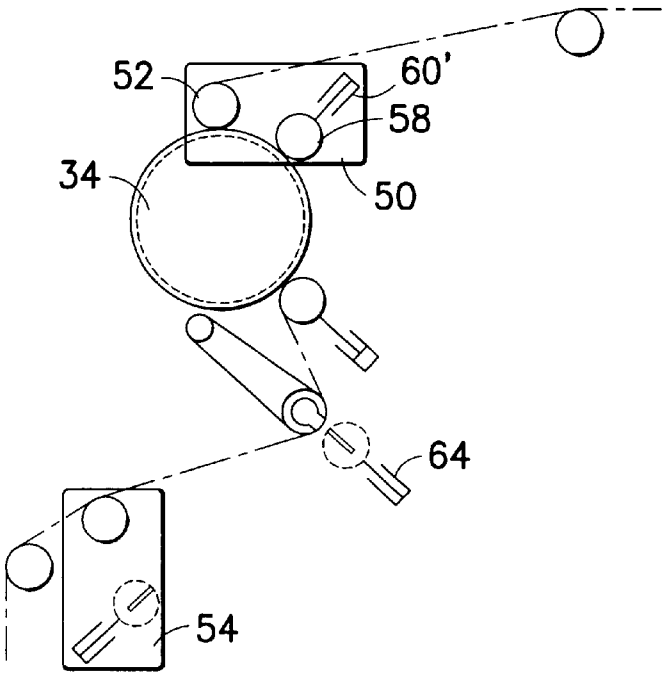

Referring now to FIG. 7, an exit carriage assembly 50 is advanced from right to left in the drawing until an exit contour roll 52 is moved into close proximity to the surface, or in contact with the surface, of vacuum roll 34. This causes web 12 to partially wrap the surface of vacuum roll 34.

Figure 8:
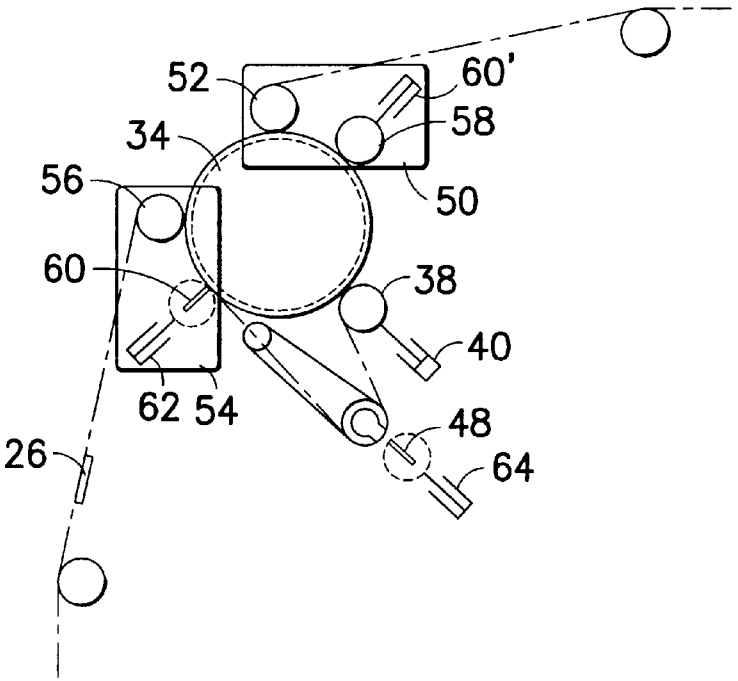

Referring now to FIG. 8, an entry carriage assembly 54 is driven into position (upward in the drawing) until an entry contour roll 56 is brought into close proximity to, or in contact with, the surface of web 12. This completes the wrapping of web 12 about vacuum roll 34.

A tape roll 58 on exit carriage assembly 50 is previously prepared with a tape (not shown in FIGS. 4–13) along its full length (into the paper in the figures). A pneumatic cylinder 60' holds tape roll 58 out of contact with web 12 at this time. A primary cutoff knife 60 on entry carriage assembly 54 is held out of contact with web 12 as it passes that location on vacuum roll 34. Secondary cutoff knife 48 is also held by its pneumatic cylinder 64 out of contact with web 12 as web 12 passes over position roll 46. At this time, a vacuum is applied to vacuum roll 34, drawing the wrap of web 12 into tight contact with vacuum roll 34. This condition is maintained until lap splice 26 reaches a location between primary cutoff knife 60 and secondary cutoff knife 48.

Figure 9:
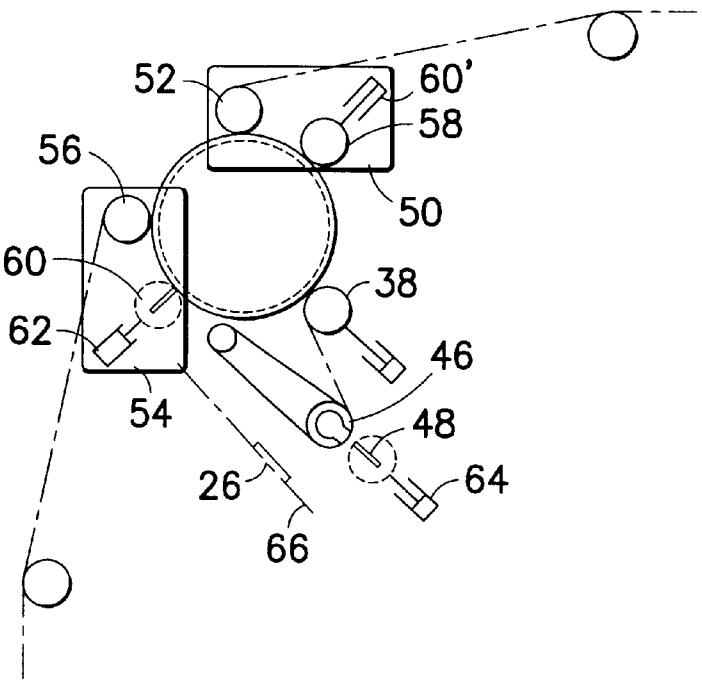

Referring now to FIG. 9, when lap splice 26 arrives between primary cutoff knife 60 and secondary cutoff knife 48, both knives are fired simultaneously by their respective pneumatic cylinders 62, 64 to sever a length of waste 66 containing lap splice 26. After performing the cuts, knives 60 and 48 are retracted immediately. The previous rotation of adjustable position arms 42, has moved position roll 46 a distance effective to increase the length of web 12 between primary cutoff knife 60 and lay-on nip 38 an amount equal to the distance between primary cutoff knife 60 and secondary cutoff knife 48. Thus, when waste 66 is removed, the remaining leading and trailing ends of the severed web have exactly the right length to abut each other as the web 12 downstream of secondary cutoff knife 48 is brought down against vacuum roll 34 alongside the leading edge of the trailing end. The portion of web 12 upstream of primary cutoff knife 60 remains drawn into firm contact with vacuum roll 34. The portion of web 12 downstream of secondary cutoff knife 48 is urged into contact with the surface of vacuum roll 34 both by the applied vacuum, and by lay-on nip 38 still in firm contact with web 12 against vacuum roll 34. Thus, the conditions for a butt splice are satisfied.

Figure 10:
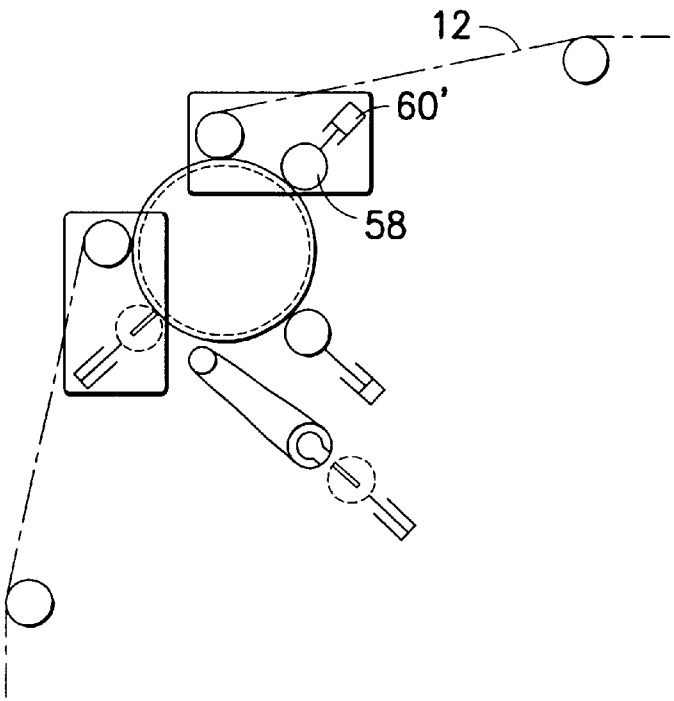

Referring now to FIG. 10, as the butted ends of web 12 rotate under tape roll 58, tape roll 58 is urged by its pneumatic cylinder into contact with web 12. This deposits the tape, previously placed along the length of tape roll 58 over the abutting ends of web 12. In this manner, butt splice 28, of FIG. 3, is completed.

Figure 11:
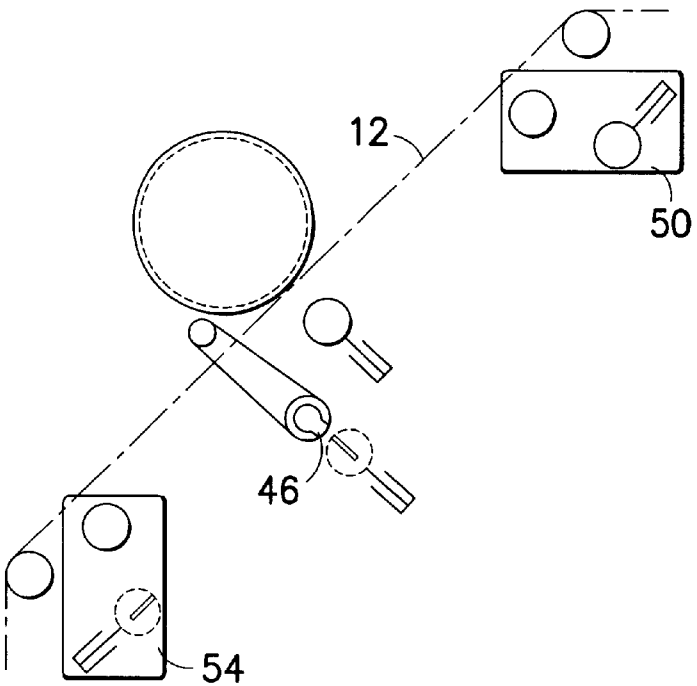

Referring now to FIG. 11, upon completion of the butt splice, entry carriage assembly 54 and exit carriage assembly 50 are returned to their original positions. Vacuum is removed from vacuum roll 34. All hydraulic cylinders are retracted. In this condition, position roll 46 is on the wrong side of web 12 to perform the next butt-splicing operation.

Figure 12:
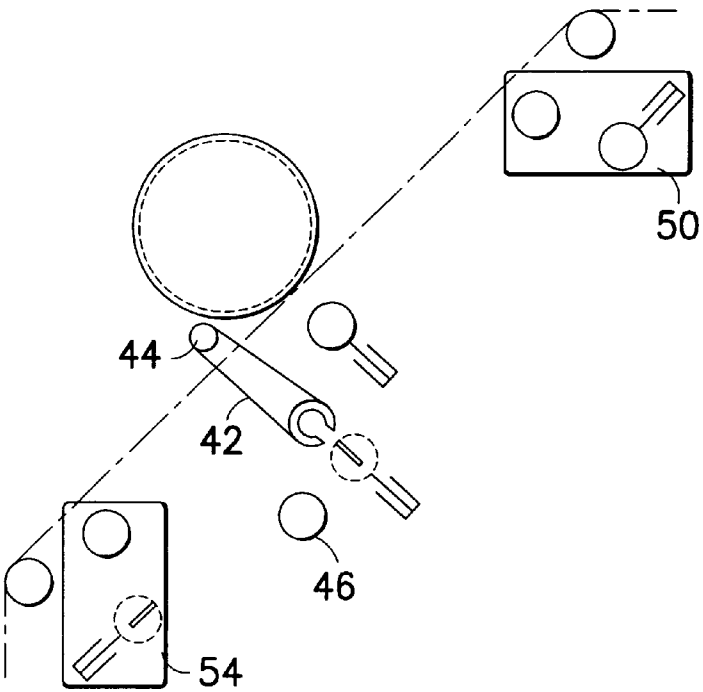

Referring now to FIG. 12, position roll 46 is removed from adjustable position arms 42, preferably by remote control, and drops into a holder (not shown) to permit adjustable position arms 42 to rotate back to their quiescent position.

Figure 13:
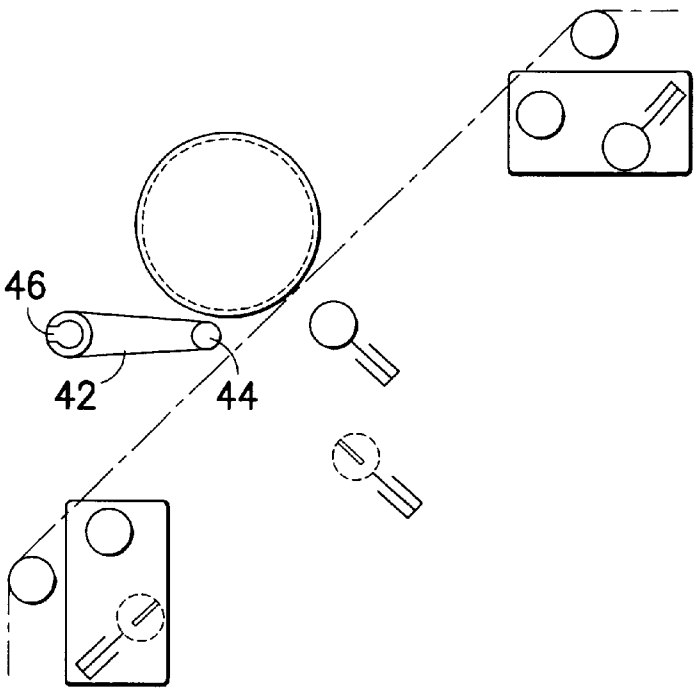

Referring now to FIG. 13, in preparation for the next operation, position roll 46 is again affixed in adjustable position arms to return butt splicer 14 to the condition shown in FIG. 4. Tape is applied to tape roll 58, whereby butt splicer 14 awaits the approach of the next lap splice.

Figure 14:
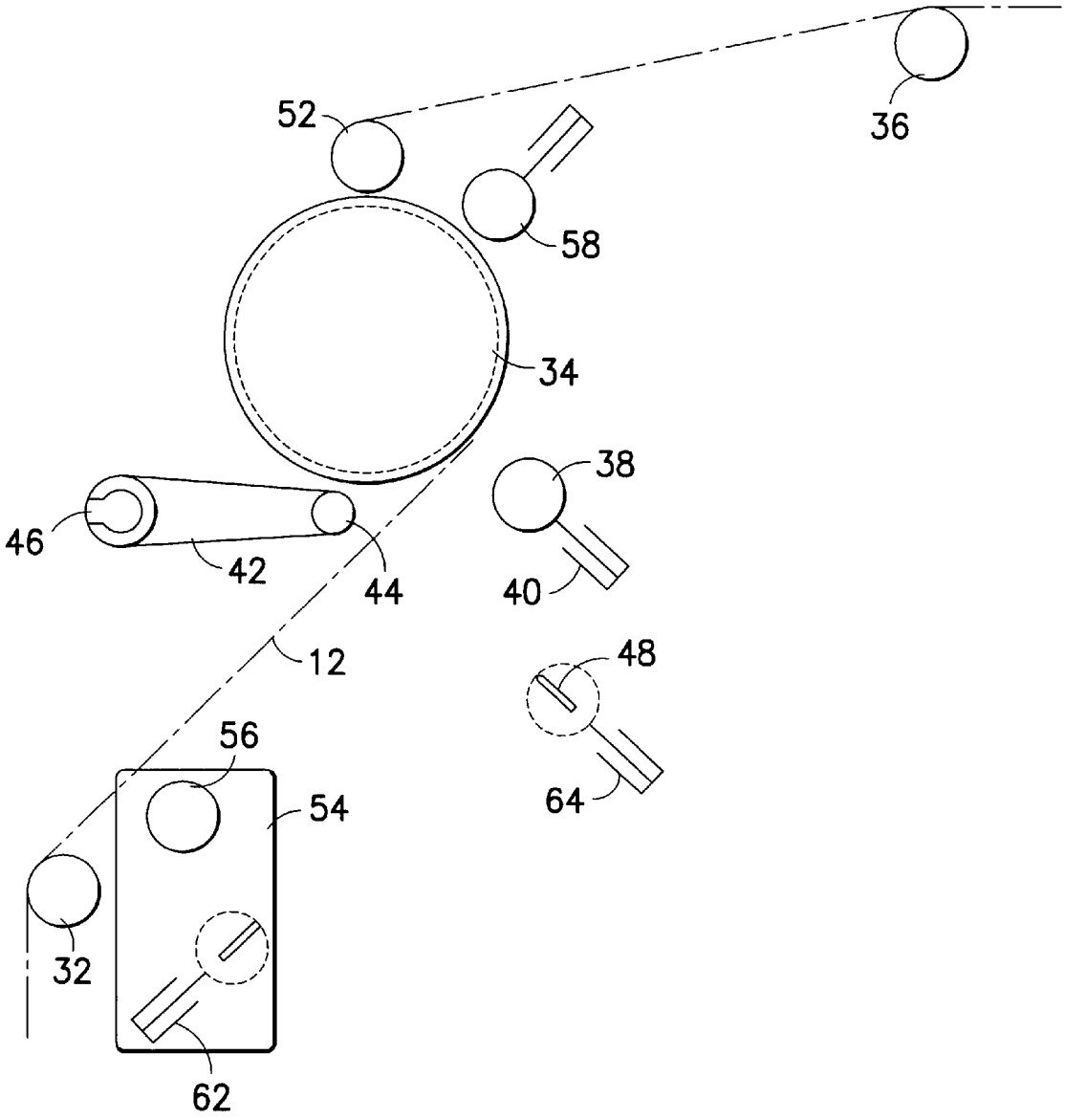
FIG. 14 shows a butt splicer according to a second embodiment of the invention.

Referring now to FIG. 14, a second embodiment of the invention omits exit carriage assembly 50 shown in prior figures. Instead, exit contour roll 52 is permanently positioned to remain urging web 12 into contact with vacuum roll 52. Tape roll 58 is positioned adjacent vacuum roll 34 with a full-length strip of tape affixed thereon, awaiting energization of its pneumatic cylinder to apply the tape to web. All other elements of the embodiment in FIG. 14 are the same in structure and function as corresponding elements in the first embodiment of the invention. Consequently, further illustration of the structure and operation thereof is omitted herefrom.

Figure 15:
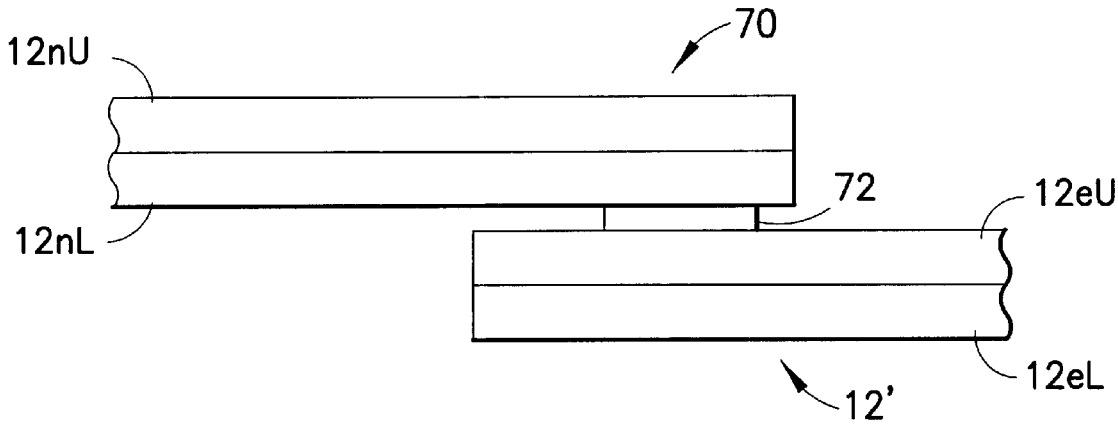
FIG. 15 is a cross section of a lap splice in a two-layer web.

Referring now to FIG. 15, the problem encountered in splicing a double-layer web 12' is illustrated. The expiring web consists of an upper layer 12*e*U and a lower layer 12*e*L. Similarly, the new web also consists of an upper layer 12*n*U and a lower layer 12*n*L. A conventional lap splice 70 is affixed between lower layer 12*n*L of the new web and upper layer 12*e*U of the expiring web. There is no way except a manual method with such a lap splice 70 to separate the upper and lower layers automatically downstream of the converting machine.

Figure 16:
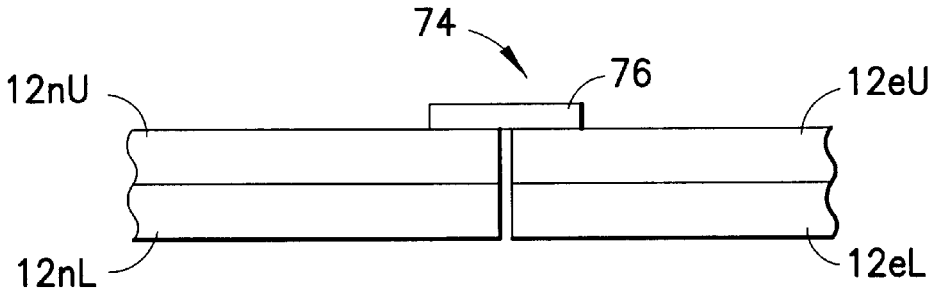
FIG. 16 is a cross section of a one-sided butt splice in a two-layer web.

Referring now to FIG. 16, a butt splice 74 of a double-layer web is shown produced by the apparatus in the present disclosure. That is, tape 76 is applied to the upper layers 12*n*U and 12*e*U. However, if it is desired to permit the using process to separate the upper and lower layers downstream of the butt splicer, an additional modification is desirable.

Figure 17:
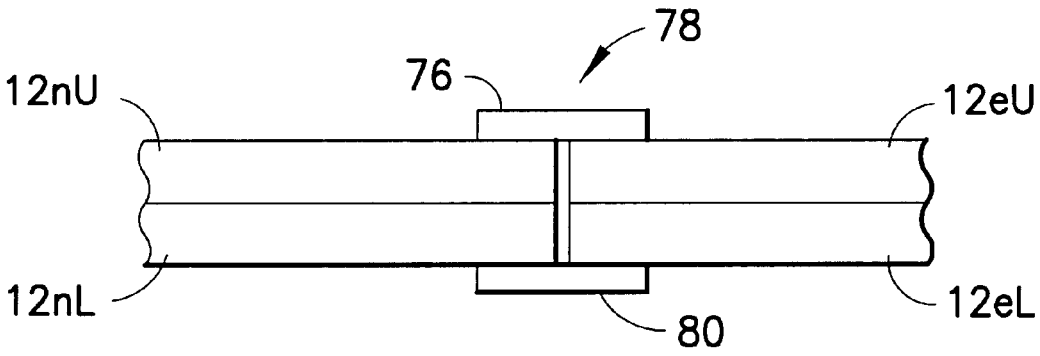
FIG. 17 is a cross section of a two-sided butt splice in a two-layer web.

Referring now to FIG. 17, a desired double butt splice 78 for a double-layer web includes a tape 76, applied by the apparatus previously disclosed, and a lower tape 80. In this structure, upper layer 12*n*U is connected to upper layer 12*e*U, and lower layer 12*n*L is connected to lower layer 12*e*L. Thus, if the using process desires to separate the upper and lower webs downstream, such an operation is provided for.

Figure 18:
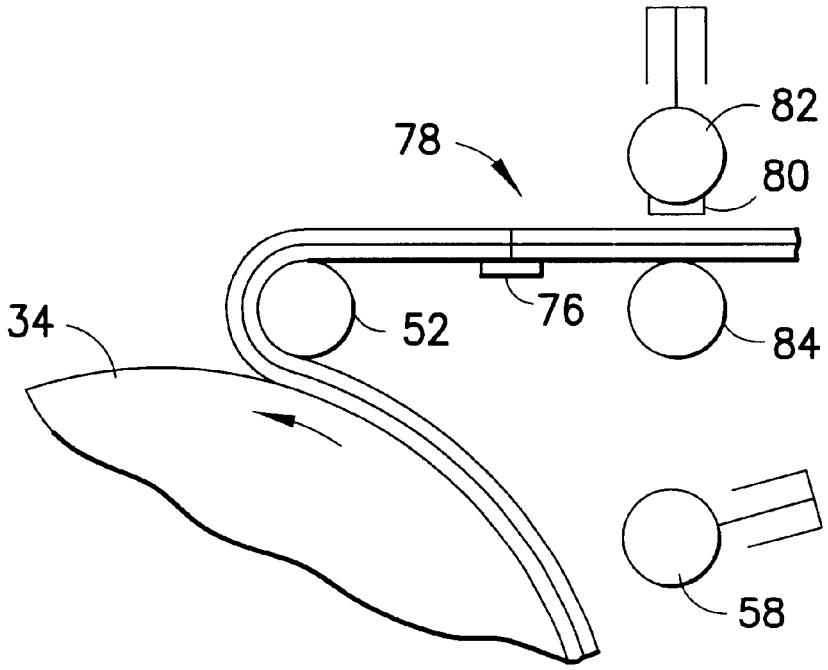
FIG. 18 is an enlarged side view of a modification of the embodiment of the invention in FIGS. 4–14 showing the apparatus for performing the two-sided butt splice of FIG. 17.

Referring now to FIG. 18, a modified apparatus according to the invention adds a second tape roll 82 facing a back-up roll 84 downstream of exit contour roll 52. Second tape roll 82 has been prepared with a full length of tape 80, and is poised awaiting the arrival of the location for double butt splice to arrive. At the appropriate time, when the location of butt splice 78 arrives between second tape roll 82 and back-up roll 84, second tape roll 82 is fired. This affixes tape 80 to complete double butt splice 78.

In the foregoing, the exact means for producing motion and controlling timing is not described, since such means are conventional, and do not represent an inventive part of the present disclosure. Entry carriage assembly 54 and exit carriage assembly 50 may be moved along tracks by a suitable linear actuator, or they may be rotated into position about rotation axes. Pneumatic cylinders may be replaced by hydraulic cylinders without departing from the spirit of the invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A butt splicer for butt splicing a web which contains a previously performed lap splice, comprising:

first and second knives;

said first and second knives being spaced apart a predetermined distance in a web-motion direction;

means for lengthening a travel distance of said web between working positions of said first and second knives from an original travel distance by an amount equal to said predetermined distance;

means for energizing said first and second knives when said lap splice passes therebetween to remove a waste portion of said web containing said lap splice;

means for restoring said original travel distance of said web, whereby severed ends of said web are placed in abutment with each other; and means for applying a tape bridging said severed ends, whereby a butt splice is produced.

2. A butt splicer according to claim 1, wherein said means for lengthening includes:

a position roll spanning said web; and means for moving said position roll to deflect said web sufficiently to increase said travel distance by said predetermined distance.

3. A butt splicer according to claim 2, wherein:

one of said first and second knives, in its working position, faces said position roll; and when energized, said one of said first and second knives severs said web against said position roll.

4. A butt splicer according to claim 1, wherein said means for restoring includes:

a vacuum roll;

means for at least partially wrapping said web about said vacuum roll at least during butt splicing;

said first knife being positioned to sever an upstream end of said web at said vacuum roll, whereby said upstream end remains adhered to said vacuum roll;

said second knife being positioned to sever a downstream end of said web at a downstream end of said lengthening; and means for at least permitting said downstream end of said web to move into contact with said vacuum roll, whereby said upstream end and said downstream end of said web are abutted on said vacuum roll.

5. A butt splicer according to claim 4, wherein said means for at least permitting includes:

a roll, downstream of said second knife; and means for urging said roll into contact with said web for urging said web against said vacuum roll, whereby said downstream end is forced onto said vacuum roll.

6. A butt splicer according to claim 1, further comprising, second means, downstream of said means for applying a tape, for applying a second tape bridging a second side of said web, whereby a double butt splice is produced.

* * * * *